United States Patent [19]

Poulin

[11] Patent Number: 4,663,951

[45] Date of Patent: May 12, 1987

[54] SECURITY DEVICE FOR THERMOSTAT

[76] Inventor: Fernand H. Poulin, 423 McDonald Street, Granby, P.Q., Canada

[21] Appl. No.: 611,012

[22] Filed: May 14, 1984

[51] Int. Cl.[4] ..... B65D 55/14; E05B 65/06; E05C 1/06

[52] U.S. Cl. ..... 70/168; 70/134; 292/142

[58] Field of Search ..... 74/530; 292/142, 172, 292/341.15; 70/168, 172, 169, 173, 134, 58, 63, 57; 248/551, 552, 553

[56] References Cited

U.S. PATENT DOCUMENTS

| | | | |
|---|---|---|---|
| 1,720,590 | 7/1929 | Evans | 292/142 |
| 2,445,036 | 7/1948 | Prentice | 292/142 |
| 2,771,313 | 11/1956 | Blake | 292/142 |
| 3,204,436 | 9/1965 | Nemsky | 70/168 |
| 3,638,461 | 2/1972 | Watson | 70/134 |
| 3,839,886 | 10/1974 | Watson | 70/134 |
| 4,203,430 | 5/1980 | Takahashi | 74/501 R |

FOREIGN PATENT DOCUMENTS

| | | | |
|---|---|---|---|
| 965872 | 9/1950 | France | 292/142 |
| 1260183 | 3/1961 | France | 292/142 |
| 1452272 | 9/1966 | France | 292/142 |
| 509840 | 2/1955 | United Kingdom | 70/58 |

*Primary Examiner*—Gary L. Smith
*Assistant Examiner*—Vinh Luong

[57] ABSTRACT

A security device for a thermostat comprising a housing for said thermostat, a lid member secured to the housing for movement between an opened position and a closed position, to gain and prevent access to the thermostat, respectively. The thermostat has a rotatable thermostat adjustment shaft extending exteriorly of the housing for manual manipulation thereof. A lock member is mounted in the housing for movement between a first position whereat the lock member lockingly engages the adjustment shaft to prevent rotation thereof and engages the lid member to prevent opening thereof and a second position whereat the lock member is disengaged from the adjustment shaft and the lid member permitting manual manipulation of the shaft or opening of the lid member and a key-operated actuating member disposed in the housing and extending exteriorly of the housing for displacing the lock member between its first and second positions.

1 Claim, 2 Drawing Figures

SECURITY DEVICE FOR THERMOSTAT

The present invention relates to a security device for use with a thermostat of the type used for controlling the heating system of a building such as a house, office and the like. More specifically, the present invention relates to a device for preventing unauthorized adjustment of and access to a thermostat.

As is well known, frequent adjustment of the temperature setting of a thermostat prevents effective and efficient operation of the heating system of a building thus increases energy consumption and costs. The present invention thus provides a security device for preventing unauthorized adjustment of the setting of a thermostat and for preventing access to the thermostat itself.

In accordance with the present invention, there is provided a security device in combination with a thermostat: a housing surrounds the thermostat, a lid member is secured to the housing for movement between an opened position and a closed position; the thermostat has a rotatable thermostat adjustment shaft which extends exteriorly of the housing for manual manipulation thereof. A lock member is mounted in the housing for movement between a first position whereat the member lockingly engages the adjustment shaft to prevent movement thereof and engages the lid member to prevent opening thereof and a second position whereat the lock member is disengaged from the adjustment shaft and the lid to permit manual manipulation of the shaft and opening of the lid. The device further includes a key-operated actuating member disposed in the chamber and extending exteriorly of the housing for displacing the lock member between the first and second positions.

These and other features of the invention will become more apparent from the following description in which reference is made to the appended drawings, wherein.

Figure 1:
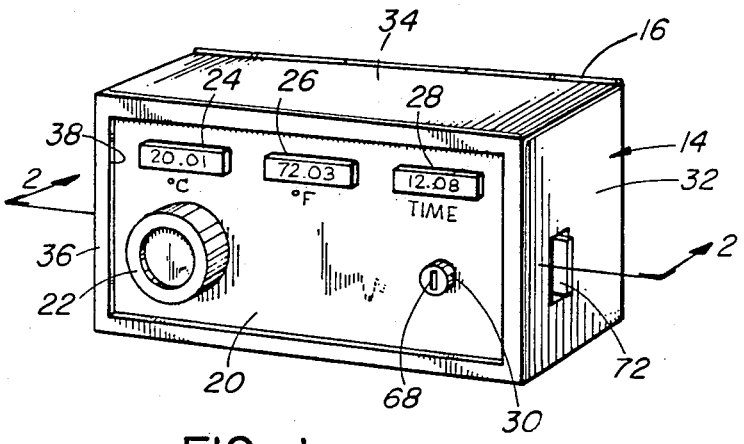
FIG. 1 is a perspective view of a thermostat security device with the lid in a closed position, a thermostat, not shown, being enclosed in the device housing.
Figure 2:
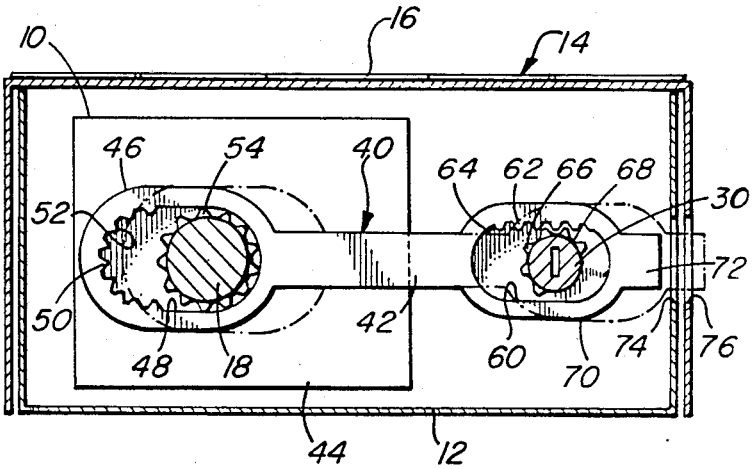
FIG. 2 is a vertical plan sectional view taken along lines 2—2 of FIG. 1.

With reference to FIG. 1 of the drawings, the device includes a housing 12 adapted to be secured to a wall and to surround a wall-mounted thermostat 10, schematically shown in FIG. 2. A lid member 14 pivotally secured to the housing by means of a hinge 16. The thermostat 10 has a rotatable thermostat adjustment shaft 18 which is accessible in an aperture (not shown) in the front face 20 of lid member 14. A knob is secured in conventional fashion to the exterior end of adjustment shaft 18. Also included in windows of the face 20, if desired, are electronic displays 24, 26 and 28 of ambient temperature in degrees Celsius, degrees Fahrenheit and the current time, respectively. The end of a key operated actuating member 30 also extends through an aperture in the front face 20 of the lid member 14. The actuating member is described in greater detail later.

Lid 14 is formed with a pair of side walls 32, 32, a top wall 34 and a front wall 36; front face 20 is part of front wall 36 and is recessed relative thereto, as shown at 38.

FIG. 2 of the drawings illustrates the security device, generally designated by reference numeral 40, of the present invention. The device includes an elongated locking member 42 which is mounted in a space 44 formed by the housing and the closed lid member forwardly of the thermostat 10. One end 46 of locking member 42 is formed with an elongated aperture or slot 48 having a toothed portion 50 at the free end 52 thereof. Aperture 48 is transversely dimensioned to receive the toothed portion 54 formed on the thermostat adjustment shaft 18. The transverse dimension of aperture 48 is such that the toothed portion of the shaft prevents transverse movement of lock member 42. It will be seen that, in the solid line position illustrated in FIG. 2, shaft 18 is free to pivot about its own axis. However, when the locking member is longitudinally displaced to the right as viewed in FIG. 2 to a position where locking teeth 50 of aperture 48 interengage the teeth of toothed portion 54 of the adjustment shaft, the adjustment shaft will be prevented from turning about its own axis.

Locking member 42 is formed with a second elongated slot 60 having a toothed portion 62 along a side 64 thereof. Aperture 60 is arranged to receive an at least partially toothed portion 66 of aforementioned actuating member 30 which is journalled in the housing for rotation about its longitudinal axis. As shown, toothed portion 66 of actuating member 30 meshes with the toothed portion 62 of aperture 60. Actuating member 30 is formed with a lock (not shown) operated by a key inserted through slot 68 in the end of the member as shown in the drawings.

End 70 of locking member 42 is formed with a latch 72 which is arranged to be received in apertures 74 and 76 of the housing and lid, respectively. Apertures 74 and 76 are arranged to be aligned with one another in the closed position of the lid.

When it is desired to lock the housing, a key is inserted into slot 68 of actuating member 30 and rotated in a clockwise direction as viewed in FIG. 2. This action causes locking member 42 to be longitudinally displaced to the dotted and dashed line position illustrated in FIG. 2 whereat latch member 72 is received in aligned apertures 74 and 76 thereby preventing opening of the lid member and wherein toothed portion 50 of slot 48 matingly engages toothed portion 54 of adjustment shaft 18 thereby preventing rotation of the adjustment shaft and alteration of the setting of the thermostat.

When it is desired to adjust the temperature setting, an authorized person inserts the key into slot 68 of actuating member 30 and rotates the key in a counterclockwise direction as viewed in FIG. 2. This action causes locking member 42 to be longitudinally displaced to the solid line position illustrated in FIG. 2 by virtue of interaction between the toothed portion of the actuating member and the toothed portion 62 of elongated slot 60 of the locking member. In this position, toothed portion 50 of the locking member is displaced from the toothed portion 54 of the thermostat adjustment shaft and thus the shaft is permitted to rotate about its own axis. Also, in this position, the authorized person may pull on knob 22 to remove the same from shaft 18 and open lid 14 to gain access to thermostat 10 for repair or the like.

It will be understood that various modifications and alterations may be made to the above described security device without departing form the spirit of the present invention.

The embodiments of the invention in which an exclusive property or privilege is claimed are defined as follows:

1. The combination of a security device and of a thermostat having a rotatable adjustment shaft, said device including a housing enclosing said thermostat, said adjustment shaft extending exteriorly of said housing for manual adjustment of said shaft, said shaft having a toothed portion disposed in said housing, a lid secured to said housing for movement between an open and a closed position to gain and prevent access to said thermostat, respectively, said lid having an opening; a key-operated actuating member rotatably mounted in said housing, parallel to and spaced from said thermostat adjustment shaft and accessible exteriorly of said housing, said actuating member having a toothed portion, an elongated lock member in said housing for selectively preventing rotation of said adjustment shaft and opening of said lid, said lock member having a first elongated aperture having a toothed portion at one end thereof, said first aperture being arranged to receive said toothed portion of said adjustment shaft, a second elongated aperture receiving said actuating member, said second aperture having a toothed portion along one side thereof constantly meshing with the toothed portion of said actuating member, and a catch portion aligned with said lid opening in said closed position of said lid, rotation of said actuating member causing said lock member to move in a direction transverse to said adjustment shaft and to said actuating member between a first position whereat said toothed portion of said first aperture is matingly engaged with said toothed portion of said adjustment shaft, thereby preventing rotation of said adjustment shaft and said catch portion is received in said lid opening, preventing movement of said lid from said closed position to said open position, and a second position whereat said toothed portion of said first aperture is radially outwardly displaced from said toothed portion of said adjustment shaft, whereby said shaft is free to rotate, and said catch portion is removed from said lid opening, whereby said lid is free to move between said open and said closed positions.

* * * * *